United States Patent [19]

Taub

[11] Patent Number: 4,482,402

[45] Date of Patent: Nov. 13, 1984

[54] DYNAMIC ANNEALING METHOD FOR OPTIMIZING THE MAGNETIC PROPERTIES OF AMORPHOUS METALS

[75] Inventor: Alan I. Taub, Schenectady, N.Y.

[73] Assignee: General Electric Company, Schenectady, N.Y.

[21] Appl. No.: 519,279

[22] Filed: Aug. 1, 1983

Related U.S. Application Data

[62] Division of Ser. No. 364,299, Apr. 1, 1982.

[51] Int. Cl.[3] ..... H01F 1/00

[52] U.S. Cl. ..... 148/121; 148/31.55; 29/605; 72/128

[58] Field of Search ..... 148/120, 121, 122, 31.55, 148/150; 29/605; 72/128

[56] References Cited

U.S. PATENT DOCUMENTS

| | | | |
|---|---|---|---|
| 3,990,923 | 11/1976 | Takashina et al. | 148/111 |
| 4,116,728 | 9/1978 | Becker et al. | 148/31.55 |
| 4,249,969 | 2/1981 | DeCristofaro et al. | 148/121 |
| 4,262,233 | 4/1981 | Becker et al. | 148/121 |
| 4,284,441 | 8/1981 | Satoh et al. | 148/120 |
| 4,286,188 | 8/1981 | Honsinger et al. | 148/121 |
| 4,288,260 | 9/1981 | Senno et al. | 148/121 |
| 4,311,539 | 1/1982 | Uedaira et al. | 148/121 |
| 4,321,090 | 3/1982 | Datta et al. | 148/31.55 |
| 4,368,447 | 1/1983 | Inomata et al. | 148/31.55 |
| 4,404,047 | 9/1983 | Wilks | 148/150 |

*Primary Examiner*—John P. Sheehan

*Attorney, Agent, or Firm*—Paul E. Rochford; James C. Davis, Jr.; James Magee, Jr.

[57] ABSTRACT

The magnetic properties of metallic alloys in amorphous form are optimized in as-formed configurations by the dynamic annealing process of this invention.

13 Claims, 14 Drawing Figures

DYNAMIC ANNEALING METHOD FOR OPTIMIZING THE MAGNETIC PROPERTIES OF AMORPHOUS METALS

This application is a division of application Ser. No. 364,299, filed Apr. 1, 1982.

BACKGROUND OF THE INVENTION

This invention pertains generally to metallic alloys in amorphous form useful in the construction of electrical and magnetic devices, and more particularly to methods for optimizing the magnetic properties of amorphous metals when formed into configurations such as cores for electrical transformers.

Amorphous metals are principally characterized by a virtual absence of a periodic repeating structure on the atomic level, i.e., the crystal lattice, which is a hallmark of their crystalline metallic counterparts. The non-crystalline amorphous structure is produced by rapidly cooling a molten alloy of appropriate composition such as those described by Chen et al., in U.S. Pat. No. 3,856,513, herein incorporated by reference.

In one such process for producing amorphous metal in commercially practicable lots, the chill-block melt spinning process, a stream of molten metal of appropriate composition is ejected from a crucible onto one or more rapidly moving chill or substrate surfaces and rapidly quenched, i.e., cooling rates on the order of about $10^{4°}$ to $10^{6°}$ C./sec, to form an elongated thin ribbon-like body whose length is appreciably greater than either its width or thickness. Due to the rapid cooling rates, the alloy does not form in the crystalline state, but assumes a metastable non-crystalline structure representative of the liquid phase from which it was formed. Due to the absence of crystalline atomic structure, amorphous alloys are frequently referred to as "glassy" alloys. The quench rates achieved during the rapid quenching and solidification are controlled primarily by the thickness of the ribbon and the effectiveness of the interfacial contact between the substrate and the ribbon.

Depending upon the composition, many unique properties can be obtained in amorphous metals which cannot necessarily be obtained in crystalline metallic alloys. The unique magnetic properties of the amorphous alloys, for example, have attracted considerable attention. As a class, amorphous alloys exhibit higher magnetic permeabilities, i.e., the ratio of magnetic flux density (B) produced in a medium to the magnetizing force (H) producing it, than crystalline alloys. Also, as a class, the amorphous alloys are more magnetically "soft", i.e., exhibit lower coercive forces (Hc), than crystalline alloys. The unique magnetic properties of amorphous metallic alloys have led to proposals that magnetically soft amorphous metallic alloys be substituted for presently used magnetically soft crystalline metallic alloys in a variety of devices and applications. Candidates for the substitution include, for example, transformers of various sizes and types in which the cores are generally presently made of grain-oriented 3% silicon steels, magnetic delay lines, magnetic recording heads, and transducers such as stress and strain gauges.

Unfortunately, the highly desirable soft magnetic properties of amorphous metallic alloys are highly stress sensitive and deteriorate rapidly with increasing stress. This stress sensitivity is potentially limiting for many applications envisioned for amorphous metals and is particularly so for transformers and the like wherein the typically thin ribbon-like amorphous metal is wound on itself layer upon layer to form the core.

In general, stresses in amorphous metal may be classified as either residual or applied. Residual stresses typically result, at least in part, from the rapid cooling rates encountered during formation of the amorphous metal, as, for example, by the above-discussed chill-block melt spinning process. Due to their origin, those residual stresses are frequently referred to as "cast-in" or "quenched-in" stresses.

Applied stresses are those which result from the direct application of a load or are present due to the configuration to which the ribbon has been made to conform, e.g., ribbon wound on itself to form a transformer core. Both types of stresses are considered equivalent insofar as they are detrimental to the magnetic properties of amorphous alloys.

It is known that stresses in amorphous metals may be relieved by isothermal annealing. The maximum temperature allowable is that temperature at which the metastable glassy alloy begins to transform to its equilibrium crystalline state, i.e., the crystallization temperature ($T_x$). The desirable soft magnetic properties of amorphous metals generally degrade rapidly with the onset of crystallization. Data in the literature indicates, however, that some crystallinity, i.e., on the order of about 2% or less, may be beneficial in some applications especially at frequencies greater than about several hundred Hertz.

The crystallization temperature is a function of several variables including, for example, local variations in composition. Unlike the melting point of a pure metal, the crystallization temperature of an amorphous alloy is generally not a fixed quality and may be influenced by the method used in its determination. Frequently, the crystallization temperature is determined by the method known as Differential Scanning Calorimetry (DSC) and then most frequently at a scanning or heating rate of 20° C./min. Another technique commonly used with the DSC method is to determine $T_x$ at several scanning rates and report as $T_x$ the value determined by extrapolating to zero scanning rate. All too frequently, however, $T_x$ is reported without reference to its method of determination.

Therefore, due to the uncertainties in the determination of $T_x$, it is preferable to anneal at temperatures sufficiently below $T_x$ to ensure that crystallization does not occur. As the stress relief annealing temperature decreases below $T_x$, however, increases in annealing time, which are undesirable from a manufacturing productivity standpoint, are required. Excessive annealing times also promote brittleness.

The balance between isothermal annealing time and temperature is particularly critical and difficult to control in applications in which the ribbon has been formed to shape, e.g., wrapped to form a transformer core, prior to the anneal. When the core is subsequently annealed, each layer of the core experiences a different temperature-time history as the heat diffuses inwardly, thus yielding a non-uniform product. Further, once the ribbon has been annealed in a configured shape, it may not be reconfigured to a different shape without reintroducing detrimental stresses.

Various methods of stress relieving a moving ribbon have emerged in response to the difficulties experienced with batch isothermal annealing. One such method is taught by Senno et al. in U.S. Pat. No. 4,288,260, which is herein incorporated by reference. The method of Senno et al. principally comprises the continuous transfer of amorphous alloy ribbon between two stations over at least one heating body situated in-between the two stations such that at least one surface of the ribbon directly contacts the heating body during transfer.

Senno et al, set forth ranges for the rate at which the ribbon should be transferred over the heated body for which temperature ranges are also set forth. Generally, at a fixed transfer rate, the magnetic properties of the ribbon treated by the method of Senno et al. improve with increasing temperature of the heating body, but the improvement appears to be limited by the onset of crystallization. As the duration of the heat treatment increases, i.e., transfer rate decreases, the magnetic properties also generally improve. Thus, the magnetic properties of amorphous ribbons treated by the method of Senno et al. improve as the process conditions approach those of isothermal annealing. No critical interrelationship between transfer rate and the temperature of the heating body is shown. Senno et al. do not attribute any criticality to post-annealing operations, particularly ribbon handling operations, as the annealed ribbon is simply collected on a take-up reel.

Another method is taught by Satoh et al. in U.S. Pat. No. 4,284,441, which is also incorporated herein by reference. By the method of Satoh et al., internal stresses in a thin strip or ribbon of amorphous alloy are alleviated and the soft magnetic properties improved by alternately imparting tensile and compressive forces to the thin strip while the thin strip is maintained at a temperature within the range in which no deterioration of mechanical properties is induced. The alternate impartment of tensile and compressive forces to the thin strip of amorphous alloy is accomplished by causing the thin strip to be moved over at least one roller having a fixed radius of curvature. The treated ribbons are collected on takeup spools or bobbins and it is generally taught that the diameter of the bobbin should be greater than the diameter of any of the rollers used in the process. Satoh et al. provide only general teachings about such variables as roller diameter, the range of heating temperature and the travelling speed of the ribbon.

Satoh et al, further teach that the internal stress of the thin strip of amorphous alloy can be alleviated merely by moving the unheated thin strip at least once over a roller in such a manner that the ribbon surface opposite to the surface which came into contact with the chill surface is held in contact with the roller. Satoh et al. also teach that a magnetic iron core having good magnetic properties can be fabricated from ribbon treated by their method by rolling the treated ribbon into a core in such a way that the inside surface of the core is formed by the ribbon surface opposite to the surface which was in contact with the chill surface. That teaching is given without any regard to the variable stresses which might thereby be introduced as the radius of the wound object changes.

SUMMARY OF THE INVENTION

Although the prior art teaches methods of both static and non-static stress relief annealing of amorphous metals to improve magnetic properties, I have found that the prior art does not fully appreciate the metallurgical phenomena which determine the relief of stresses and the development of optimum soft magnetic properties in amorphous metals. I have further found that the prior art methods are not capable of producing amorphous metals that are substantially completely stress-relieved and, therefore, do not have optimized soft magnetic properties. Therefore, there existed, prior to my invention, a lack of understanding and methodology for optimizing the soft magnetic properties of amorphous metals particularly when those amorphous metals are deformed and configured into useful shapes such as the cores of electrical transformers.

I have found that the competing material processes of flow and structural relaxation must be accounted for in order to optimize the development of soft magnetic properties in amorphous metals. Specifically, flow must be maximized and structural relaxation must be minimized. Once that state is obtained with the amorphous metal in its final shape, that state must be preserved.

Briefly, the process that I have developed based on my newly found understanding of the material processes of amorphous metals, which I have termed dynamic annealing, involves (a) forming a single thickness of the amorphous metal, typically in the form of a ribbon-like body, to a predetermined final shape or configuration; (b) rapidly heating the thusly formed amorphous metal so as to maximize flow and minimize structural relaxation by heating to the highest peak temperature at the most rapid heating rate attainable subject to the proviso that substantially no crystallization is induced in the amorphous material in the time required during this step to reduce the stresses in the amorphous material by at least 90%, and preferably by at least 95%, of the stresses present in the amorphous material immediately prior to initiation of this heating step; and (c) rapidly cooling the amorphous metal while maintaining the formed shape.

Since the process is preferably performed on a ribbon, moving continuously or incrementally, each increment of the ribbon-like body is essentially given a separate time-temperature stress relief cycle at the instantaneous shape which it will have in the final product which tailors it to a final substantially stress-free configuration having optimized soft magnetic properties. Typically and preferably the rate of rapid heating is equal to or greater than about 300° C./min which is a rate obtainable with beams of energized particles and heat beams, such as those emanating from electron beam devices, line heaters and laser devices, or by resistance self-heating.

The products of my invention are broadly described as discrete bodies which are substantially uniformly stress-free throughout and have optimized soft magnetic properties which are also substantially uniform throughout comprised of a plurality of layers or thicknesses of amorphous metallic material which have been dynamically annealed by the method of the invention to render the material in the as-formed body substantially stress-free, i.e., relieved of at least 90%, and preferably 95% or more, of the initial stress present in the material before dynamic annealing.

BRIEF DESCRIPTION OF THE DRAWINGS

The practice of my invention may be more fully understood and its features and advantages more readily appreciated by the detailed description provided hereinbelow with reference to the appended FIGURES wherein, briefly.

DETAILED DESCRIPTION OF THE INVENTION AND PREFERRED EMBODIMENTS

There are two factors which govern the relief of stresses in amorphous metals. Those two factors are flow and structural relaxation. Flow refers to homogeneous deformation in response to stress. Flow, in turn, consists of two components, i.e., viscelastic or irreversible flow and anelastic or reversible flow, which are described in more detail below.

Figure 1A:
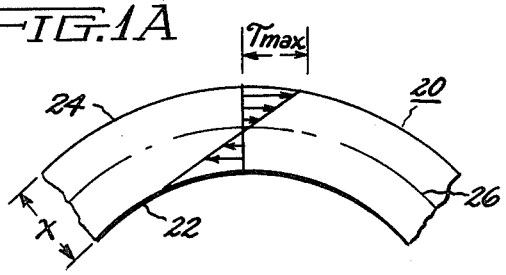
FIG. 1A is a schematic representation of the state of stress in a bent segment of a thin ribbon-like body.

A stress pattern such as is found in a bent or coiled segment of amorphous metal ribbon is shown in FIG. 1A. As discussed above, the total stress will consist of at least an applied component due to the bent shape of the ribbon and quite typically a residual component due to quenched-in stresses. The stress pattern of FIG. 1A varies linearly through thickness, x, of ribbon segment 20 from maximum compressive at inner surface 22 to zero at neutral axis 26, to maximum tensile at outer surface 24. In the FIGURES and following discussion, the tensile and compressive stresses are expressed in terms of the absolute value of the equivalent shear stress $|\tau|$.

If amorphous metal ribbon 20 is heated to an elevated temperature, $T_a$, above room temperature, i.e., annealed, the amorphous metal of ribbon 20 will flow in response to the stress $\tau$. According to classical prior art theory, such an annealing process will result in a stress-free ribbon if conducted for a sufficient time. The higher the annealing temperature is above room temperature, the less time will be required for stress relief.

Figure 1B:
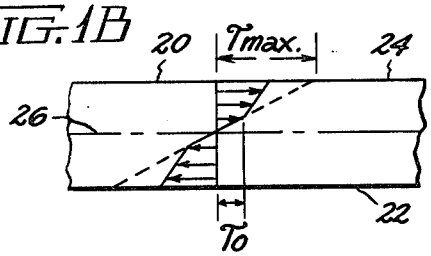
FIG. 1B is a schematic representation of the state of stress in a segment of a thin ribbon-like body at an intermediate time during a stress-relief anneal showing partial relief of the internal stresses.
Figure 1C:
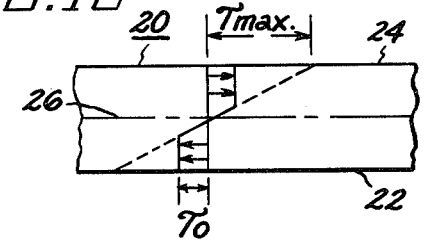
FIG. 1C is a schematic representation of the state of stress in the ribbon-like body of FIG. 1B following completion of the annealing treatment.

In contrast to the classical theory, I have found that for amorphous metals there is a threshold value of stress, $\tau_o$, below which the stresses will not decay or relieve. As ribbon 20 is annealed, that portion of ribbon 20 subjected to an absolute stress of $|\tau|>\tau_o$ exhibits flow while those portions of ribbon 20 subjected to an absolute stress of $|\tau|<\tau_o$ exhibit no flow as is shown schematically in FIG. 1B. Ultimately, the stress distribution shown in FIG. 1C is obtained. Annealing at high temperatures has the advantage of reducing the residual stress pattern since $\tau_o$ decreases with increasing temperature. However, as discussed above, the closer the annealing temperature $T_a$ is to $T_x$, the crystallization temperature, the more likely is the possibility that detrimental crystallization will occur.

Figure 2:
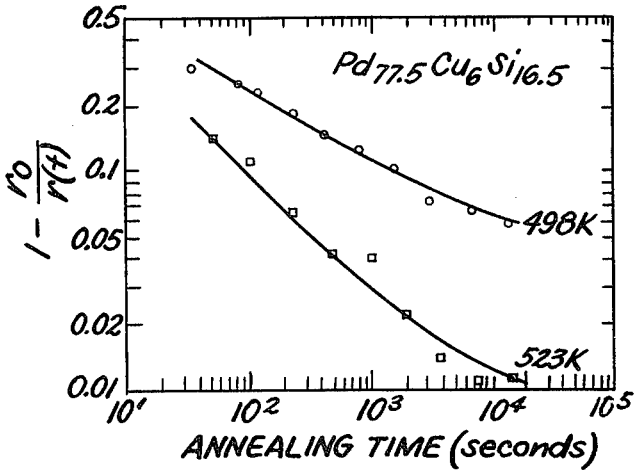
FIG. 2 is a log-log graph of the stress relief fraction in bending versus annealing time for $Pd_{77.5}Cu_6Si_{16.5}$ amorphous metal ribbons annealed at 498° and 523° K.

A model which I have developed which provides a complete description of the kinetics of stress relief in amorphous alloy ribbons bent to an initial fixed radius, $r_o$, and incorporates the threshold value $\tau_o$ is as follows:

$$\left[1-\frac{r_o}{r(t)}\right]=K+[1-K]\left[1+\frac{\dot{\eta}_t}{\eta_o}\right]^{-E/3\dot{\eta}} \quad (1)$$

where $r(t)$=unconstrained natural radius of curvature of the ribbon as a function of time, t;

$\tau_{max}=\tau_i$=maximum shear stress at t=0;

$\tau_o$=threshold value of the equivalent shear stress;

E=elastic modulus (Young's Modulus);

$\eta_o$=viscosity at t=0;

$\dot{\eta}$=rate of viscosity increase with time, and $K=(3/2)(\tau_o/\tau_{max})-\frac{1}{2}(\tau_o/\tau_{max})^3$ The correspondence between the model and the stress relief of an as-cast $Pd_{77.5}Cu_6Si_{16.5}$ amorphous alloy ribbon at two annealing temperatures, 498° and 523° K., is shown in FIG. 2. The solid symbols represent actual data points and the solid lines represent the model of equation (2). The degree of stress relief increases with both testing time and testing temperature and asymptotically approaches the x-axis at long annealing times. The difference between the asymptotic value and 100% stress relief is due to $\tau_o$.

The second factor, structural relaxation, occurs in parallel with flow during stress-relief annealing. I have found that this second factor must also be accounted for in order to optimize the stress-relief annealing of amorphous alloys. The origin of structural relaxation may be explained with reference to FIG. 3.

Figure 3:
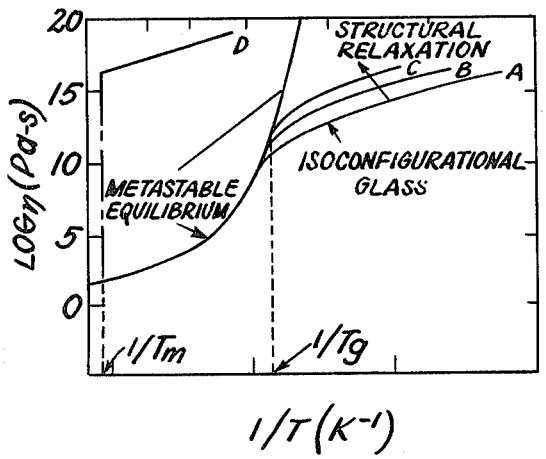
FIG. 3 is a graph of the logarithm of viscosity versus inverse temperature which shows schematically the formation of the amorphous metallic state and wherein the phenomenon of structural relaxation is also schematically represented.

When a molten glass-forming metallic alloy is quenched rapidly enough to avoid crystallization, the equilibrium liquid properties are extrapolated into the metastable regime below the melting temperature, $T_m$, as shown schematically in FIG. 3. As the temperature decreases below $T_m$ during this quench, the atomic mobility is sufficient to permit the atomic structure of the alloy to continuously adopt equilibrium configurations. This rearrangement continues until the region of the glass transition temperature, $T_g$, is reached. At some temperature near $T_g$, the atomic configuration becomes "frozen" because the resistance to atomic motion, i.e., the viscosity, is large enough to restrict structural rearrangement. That is, the time required for the atoms to adopt their equilibrium configurations is greater than the quenching time scale, so the alloy structure deviates from equilibrium. This deviation is shown schematically by curve A of FIG. 3. This curve represents the isoconfigurational, i.e., constant structure, properties of the alloy. In constrast, curve D shows the behavior of the same alloy quenched at a much slower rate and solidified directly to the crystalline state.

Subsequent heat treatment of the glassy alloy at temperatures below $T_g$ allows the atomic structure to approach its equilibrium configuration. Significant shifts of the isoconfigurational curves toward the equilibrium curve, as shown schematically by curves B and C of FIG. 3, have been observed for anneals at the same temperatures and times used in stress relief anneals.

Structural relaxation is, therefore, an unavoidable consequence of stress relief annealing. This has an important effect on the properties of the amorphous metal. First, the viscosity increases, i.e., the atomic mobility decreases, as just described. This increase in flow resistance has been associated with embrittlement of the alloy. Perhaps more important for soft magnetic applications is the interaction of the structural relaxation with the flow of these materials and, more specifically, the viscoelastic and anelastic components discussed above since those components interact with the material to produce a magnetic anisotropy.

For positive magnetostriction materials, such as the alloys proposed for transformer applications, flow along the ribbon length produces an anisotropy perpendicular to the lengthwise ribbon axis which is detrimental to transformer performance. It appears that the anelastic flow is primarily responsible for the inducement of this anisotropy. Structural relaxation is important because of its effect on the flow mechanism. Structural relaxation has been shown to dramatically decrease the viscoelastic strain rate. Therefore, it is expected that flow in a non-relaxed glass, i.e., a low viscosity glass, will have a higher ratio of viscoelastic to anelastic flow than in a relaxed glass, i.e., a high viscosity glass. Thus, if a large amount of structural relaxation occurs during a stress relief anneal, it would be expected that a larger percentage of the flow would be anelastic than if a small amount of structural relaxation occurred. This, in turn, would lead to a larger induced detrimental anisotropy.

I have found that mere knowledge of the phenomena of flow and structural relaxation in amorphous metals is inadequate to enable one to optimize the stress relief and magnetic properties of amorphous metals. As I have discovered, it is necessary to understand the interaction between flow and structural relaxation in order to optimize the stress relief of amorphous metals. To explain that newly found understanding, I have derived FIG. 4.

It is known that the temperature dependence of the viscosity for a constant structure, $\eta_o$, and the rate of viscosity change with temperature, $\dot{\eta}$, may be closely approximated by:

$$\eta_o = N_o e^{Q_{iso}/kT} \tag{2}$$

and $$\dot{\eta} = \dot{N}_o e^{Q_{\dot{\eta}}/kT} \tag{3}$$

respectively, where $N_o$=pre-exponential material parameter;

$\dot{N}_o$=pre-exponential material parameter;

$Q_{iso}$=activation energy for flow at constant structure;

$Q_{\dot{\eta}}$=activation energy for rate of viscosity increase;

k=universal gas constant in appropriate units; and

T=absolute temperature (°K.)

Equations (2) and (3) may be combined with equation (1), which expresses the relationship between stress and time at a constant temperature, to yield the following equation $$t = [C^{-3\dot{\eta}/E} - 1]\frac{N_o}{\dot{N}_o} e^{(Q_{iso}-Q_{\dot{\eta}})/kT} \tag{4}$$

which expresses the relationship between time and temperature of an amorphous metal flowing at a constant stress where $$C = \frac{\tau(t) - \tau_o}{\tau_i - \tau_o}$$

with the remaining terms being defined as above.

Figure 4:
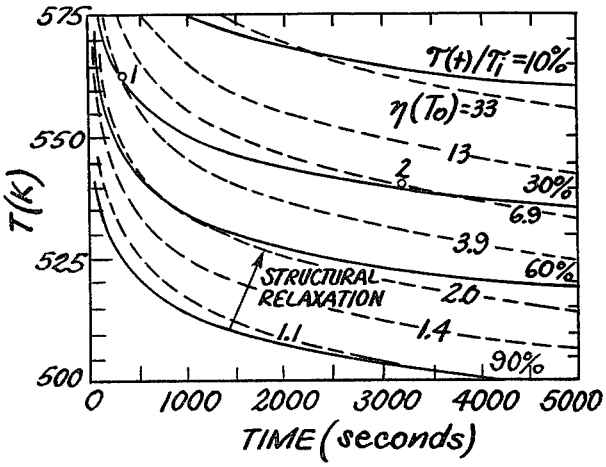
FIG. 4 is a graph of temperature versus time, whereon several isoflow and isostructural contours are plotted, which illustrates the interaction between flow and structural relaxation.

The solid curves of FIG. 4 represent the solution of flow equation (4) for the various values of $\tau(t)/\tau_i$ shown. As the value of $\tau(t)/\tau_i$ decreases, the amount of flow increases.

Equations (3) and (4) may be combined to yield the following equation:

$$\ln\frac{t}{t_o} = \frac{Q_{iso} - Q_{\dot{\eta}}}{k}\left(\frac{1}{T} - \frac{1}{T_o}\right) \tag{5}$$

wherein t is time, $t_o$ is an arbitrary reference time, and $T_o$ is an arbitrary reference temperature with the remaining terms as previously described, which permits the plotting of the dashed isostructural contours on FIG. 4. Referring back to FIG. 3, the initial state of an as-cast amorphous alloy is represented by curve A. During annealing, the isoconfigurational curve will shift towards the equilibrium curve as shown by intermediate curves B and C. In FIG. 4, the structural relaxation is represented by the shift of the dashed curves toward higher values of $\eta(T_o)$. The parameters used in Equations (4) and (5) to construct FIG. 4 were: E=100 GPa, $\tau_o$=15 MPa, $Q_{iso}$=220 kJ/mole, $Q_{\dot{\eta}}$=35 kJ/mole, $\dot{N}_o = 1\times10^{-8}$ Pa-s, and $N_o = 2\times10^{7}$ Pa. These are typical values for many amorphous alloys.

FIG. 4 may be used to compare the relative rates and effects of stress relief and structural relaxation. Two points of constant stress relief fraction are marked on FIG. 4 as points 1 and 2. Point 1 is for an isothermal anneal performed at 563° K. and 300 seconds. Point 2 is for an anneal at a lower temperature of 540° K. for a longer time of 3100 seconds. In both cases, the stress has been relieved to the same value of $\tau(t)/\tau_i$, i.e., 30%, which represents that 70% of the stresses initially present have been relieved. Point 1, however, intersects an isothermal contour that corresponds to a lesser degree of structural relaxation (3.9) than the corresponding isostructural contour for point 2 (6.9).

Since lower degrees of structural relaxation reduce the opportunity for detrimental anelastic flow and concomitant detrimental induced anisotropy to occur, and also reduce the opportunity for embrittlement, it is expected that an amorphous metal stress relieved at the conditions of Point 1 would have better magnetic properties and be less brittle than the same metal stress relieved at the conditions of Point 2. My FIG. 4 thus explains why isothermal annealing or annealing at slow feed rates and low temperatures is undesirable, i.e., by the time an adequate amount of flow has been achieved to effect the desired amount of stress relief, too much detrimental structural relaxation has occurred.

Since the curves of FIG. 4 slope steeply upward at small values of time, the only way to obtain the benefits of minimized structural relaxation is to heat as rapidly as possible to the annealing temperature to minimize the number of isoconfigurational contours intersected. Heating rate, however, is not the only variable involved. Another relevant, but not independent, factor is crystallization. For the purposes of my invention, it is desirable that substantially no crystallization occur in the amorphous metal during dynamic annealing in order that soft magnetic properties are optimized. Substantially no crystallization means that the amorphous metal contains no more than about 2% crystallinity by volume as measured by such analytical techniques as X-ray and electron diffraction and light microscopy, or combinations thereof, or as may be inferred from magnetic measurements.

The crystallization behavior of amorphous metals is a function of the crystallization temperature, $T_x$, which increases with heating rate, dT/dt, and the time required for crystallization, $t_x$, which decreases with increasing annealing temperature, $T_a$. Thus, given the criteria that substantially no crystallization is to be induced in the amorphous metallic alloy during annealing, there are three interrelated variables that must be satisfied, i.e., the annealing temperature ($T_a$), the time ($t_a$) at the annealing temperature, and the heating rate to the annealing temperature ($dT_a/dt$). Those variables are subject to the additional condition that the annealing time and annealing temperature must be sufficient to provide adequate relief of the stresses and that once stress relieved no permanent stresses are reintroduced into the material. Lastly, once the objectives are obtained, it is necessary to cool sufficiently rapidly from the annealing temperature to prevent any significant additional structural relaxation from occurring and/or to prevent any additional significant crystallization, if any, to the limit of no more than about 2% by volume, from occurring.

Figure 5:
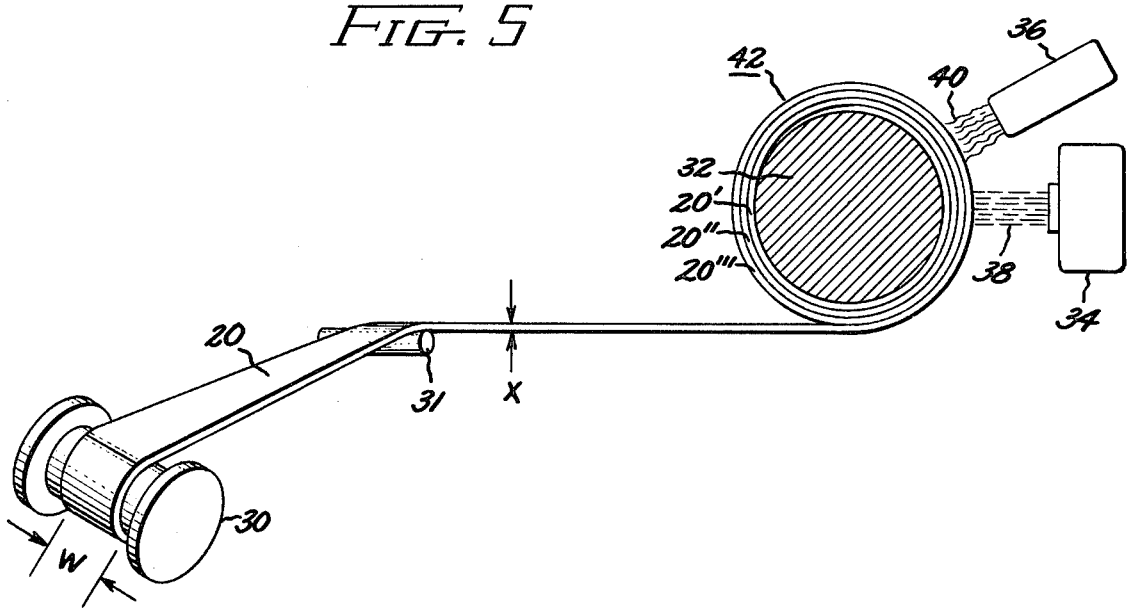
FIG. 5 shows schematically an elementary apparatus suitable for the practice of the dynamic annealing process of the invention.

The dynamic annealing apparatus shown schematically in FIG. 5 was built in order to implement my above-discussed novel discoveries about the stress relief of amorphous metals. In the apparatus of FIG. 5, amorphous metal ribbon 20 of width, W, and thickness, x, is pulled under constant tension from supply spool 30 past guide roller 31 and wrapped around core form 32. Heat from concentrated heat source 34 is directed at a single thickness of ribbon 20 after it has attained its final configuration which, as shown, is a spiral of ever-increasing diameter. Ribbon 20 is then rapidly cooled by means 36 to prevent heat buildup in previously treated and wrapped layers, e.g., layers 20', 20'', and 20'''. It is essential that ribbon 20 not be heated until after it has reached its final configuration; otherwise, structural relaxation will commence before all the winding stresses have been applied thus lessening the discovered advantages of my invention.

Source 34 preferably provides heat in the form of beam 38 in order to attain heating rates as close as possible to a theoretically preferred infinite heating rate. Suitable sources 34 include, for example, devices which emit electron beams, laser beams, and radiant heat beams. It is also contemplated that means employing direct contact with ribbon 20, such as resistance self-heating through a pair of appropriately situated contact points or probes (not shown), will also provide heating rates sufficiently rapid to enable realization of the benefits of my invention. Additionally contemplated are fluid heating media such as a plasma and a molten salt bath.

Cooling means 36 supplies a jet 40 of a cooling medium, such as air or an inert gas like nitrogen, to ribbon 20 immediately after ribbon 20 exits the area of impingement of beam 40. This cooling serves to "freeze" the as-annealed stress-free structure in ribbon 20 preventing any further significant additional structural relaxation and minimizes the detrimental passage of heat into previously annealed layers 20' and 20''. The use of non-gaseous jets 40, such as streams of water or other suitable liquid quenchants, is also contemplated.

Following rapid heating and rapid cooling while at the final shape, annealed and stress-relieved ribbon 20 is subsequently wound or wrapped layer upon layer about core form 32 to produce product 42. Typically, core form 32 may be circular or polygonal in cross-section and may be solid or hollow. The length of product, or discrete body 42, measured perpendicular to its cross-sectional area, is equal to the width, W, of ribbon 20. More than one body may be wound, one adjacent to the next along the length of the core form, on the same core form. Although wound on a core form, the final products may or may not have the core form present.

Thus, the products 42 of the invention may generally be described as discrete bodies which are substantially uniformly stress-free throughout having been formed from a plurality of layers or thicknesses of amorphous metallic ribbon, successively wrapped one on top of the other, which have been dynamically annealed by the method of the invention to render the ribbon as-wrapped substantially stress-free, i.e., relieved of at least 90%, and preferably 95% or more, of the initial stresses present in the ribbon in the unwrapped state. As will be developed in greater detail below, the bodies will also have optimized soft magnetic properties which are substantially uniform throughout by reason of the dynamic annealing process and their substantially uniform stress-free state throughout.

As will be appreciated by those skilled in the transformer manufacturing arts, the apparatus of FIG. 5, as well as the other apparatus described herein, may also be adapted to coat ribbon 20 with an insulating material or to interleave ribbon 20 with an insulating material prior to final wrapping around core form 32. Further, the appartus described herein can be equipped to provide means for applying a magnetic field to the ribbon during dynamic annealing to further enhance the magnetic properties of amorphous metallic ribbon treated by the method of my invention.

Figure 6:
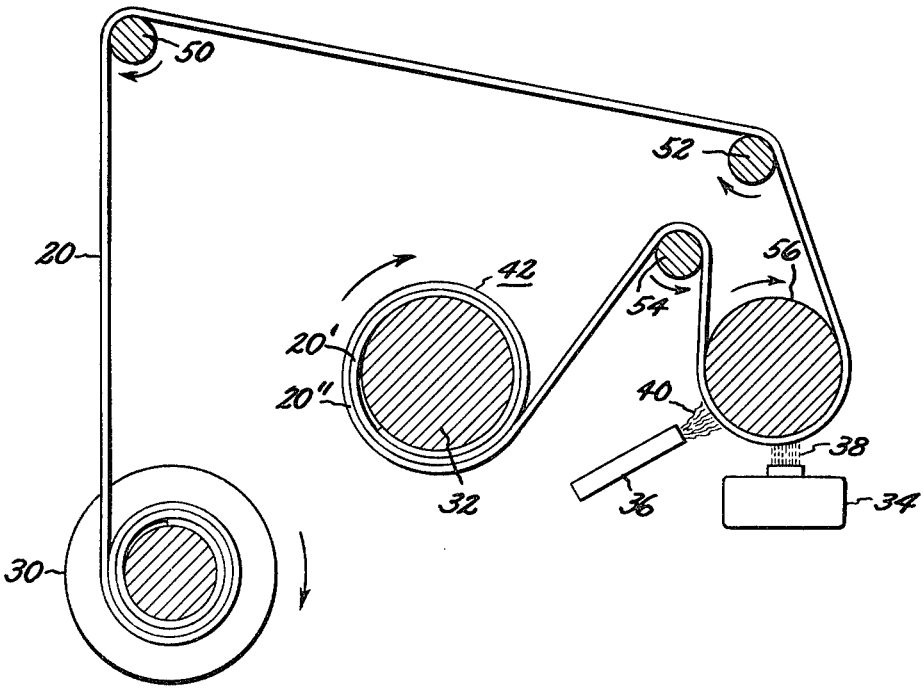
FIG. 6 shows schematically another embodiment of apparatus suitable for the practice of the dynamic annealing process of the invention wherein the amorphous metallic ribbon is dynamically annealed at a location remote from the final product.

Another apparatus suitable for the practice of my invention is that shown in FIG. 6. The apparatus of FIG. 6 is generally similar to the apparatus of FIG. 5 and like components are similarly numbered. The apparatus of FIG. 6 comprises additionally guide rollers 50, 52 and 54. In the apparatus of FIG. 6, the rapid heating and rapid cooling of ribbon 20 takes place as ribbon 20 traverses the exterior surface of drum or roller 56 and subsequently passes over roller 54 to be wound upon core form 32. The principal advantage of the apparatus of FIG. 6, compared to the apparatus of FIG. 5, is that heating by beam 38 takes place in a manner such that the heat from beam 38 is positively restricted to a single thickness of that segment or increment of ribbon 20 being treated and cannot diffuse into previously annealed and wrapped layers of the ribbon. A similar effect could be obtained in the apparatus of FIG. 5 by placing a fixed insulating member (not shown) beneath that portion of ribbon 20 upon which beam 38 impinges to separate it from the previously dynamically annealed ribbon previously wrapped on core form 32.

Fixed or rotatable drum or roller 56 is also preferably designed to be adjustable so that its instantaneous diameter during heat treatment of ribbon 20 by beam 38 and jet 40 is equal to the diameter, curvature or configuration which ribbon 20 will have when coiled about core form 32 on top of the previously wrapped layers. Guide roller 54 should have a diameter sufficiently large such that the passage of annealed and stress-relieved ribbon 20 thereover will not introduce any plastic strains into ribbon 20.

Figure 7:
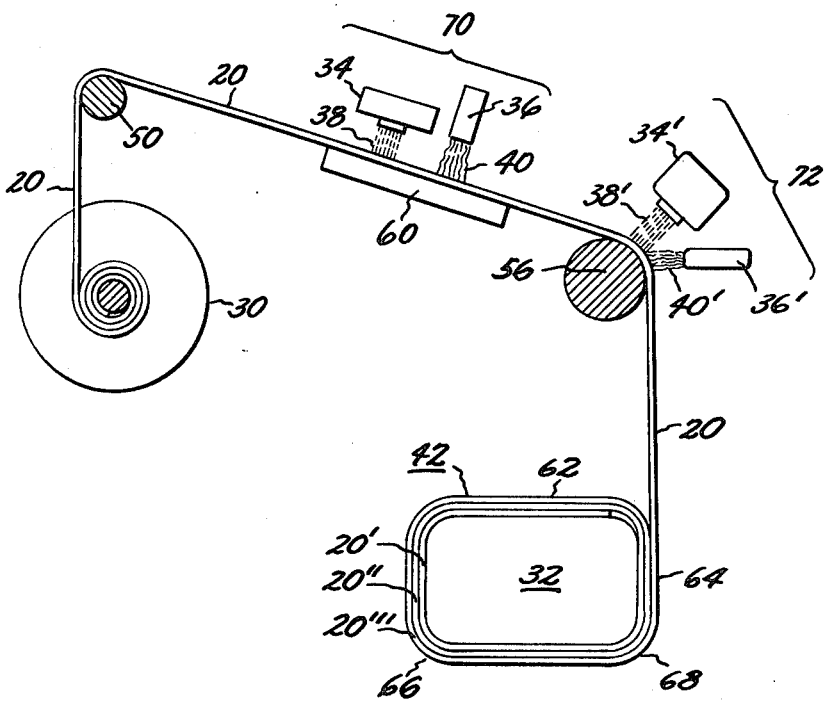
FIG. 7 shows schematically a further embodiment of apparatus suitable for the practice of the process of the invention employing two sequentially operated stations for producing dynamically annealed ribbon suitable for forming, for example, a wound substantially stress-free product of substantially rectangular cross-section.

The apparatus of FIG. 7 illustrates the use of the method of my invention to produce product 42 having a substantially rectangular cross-section. Again, elements of the apparatus of FIG. 7 which are identical to the elements described in conjunction with the apparatus of FIGS. 5 and 6 are similarly numbered. In the apparatus of FIG. 7, amorphous metal ribbon 20 leaves spool 30, passes over guide roller 50 and across platen 60 at dynamic annealing station 70 whereat those segments which will be straight in final product 42, e.g., segments or increments 62 and 64 are dynamically annealed by rapidly heating by means of beam 38 from device 34 and subsequently rapidly cooled by means of jet 40 from cooling means 36. Those segments of ribbon 20 which will be located at the rounded corner segments in final product 42, e.g., segments or increments 66 and 68, are dynamically annealed at station 72 by means of beam 38' from device 34' and cooled by jet 40' from cooling means 36' as those segments pass over adjustable drum or roller 56. Suitable control means (not shown) are provided to suitably sequence the dynamic annealing apparatus at stations 70 and 72 and suitably adjust the diameter of roller or drum 56.

In order to further teach the practice of my invention, and to compare the magnetic properties of amorphous metal ribbons stress relieved by the dynamic annealing method of my invention to those stress relieved by methods of the prior art, the following illustrative, but not limiting, examples and discussion are herewith provided.

EXAMPLE I

Using the apparatus of FIG. 6, wherein heat source 34 was a quartz line heater manufactured by Research, Inc., which emitted a focused beam of heat 38, a series of $Fe_{81.5}B_{14.5}Si_4$ amorphous metal ribbons 41 μm thick by 12 mm wide were dynamically annealed by the method of the invention under the conditions set forth in Table I (Samples A1–A6). Cooling was accomplished by blowing a jet of nitrogen 40 from cooling means 36 in the form of a small diameter tube positioned in close proximity to both ribbon 20 and the location at which beam 38 impinged on ribbon 20.

The ribbons were formed into spirally wound bodies by winding five to fifteen turns or layers about a core form having a diameter of 4.5 cm. Since the diameter of the outermost turn was not significantly different from the diameter of the innermost turn, because only a few layers were wound, it was considered that no stresses would be introduced during winding, thus drum 56 had a fixed and not a variable diameter. Direct and alternating current magnetic measurements were made on the spirally wound bodies with the results also set forth in Table I.

In order to obtain a measurement of the heating rate produced in ribbon 20 by the apparatus of FIG. 6, the outside surface of drum 56 directly beneath the locus of impingement of beam 38 was instrumented with cemented-on foil chromel-alumel thermocouples. Separate measurements made on some ribbons directly instrumented with a 5 mil beaded and flattened chromel-alumel thermocouple spot welded to the face of ribbon 20 opposite to heat source 34 verified that the cemented-on foil thermocouples accurately reflected the heating rate. The spot welded thermocouples additionally provided a measurement of the cooling rate.

TABLE I

| SPECIMEN | HEATER VOLTS | FEED RATE (cm/min) | $T_{peak}$ (°C.) | HEATING RATE (°C./min) | STRESS RELIEF FRACTION (%) | MAGNETIC PROPERTIES DC Hc (mOe) | DC $B_1/B_{100}$ (%) | AC @ 14 k guass mWatts/Lb | AC @ 14 k guass mVA/Lb |
|---|---|---|---|---|---|---|---|---|---|
| A1 | 230 | 4 | 448 | 240 | 100 | 33 | 80 | ND | ND |
| A2 | " | 8 | 436 | 458 | 100 | 33 | 88 | 128 | 269 |
| A3 | " | 18 | 398 | 924 | 96 | 28 | 84 | 117 | 657 |
| A4 | " | 26 | 350 | 1300 | 93 | 33 | 74 | 112 | 2500 |
| A5 | " | 34 | X | X | 90 | 35 | 67 | 119 | 5600 |
| A6 | " | 53 | X | X | 68 | 45 | 59 | ND | ND |
| A7 | N/A | None Isothermal | 365 (2 hrs) | 10–15 | 100 | 63 | 77 | 154 | 1200 |
| A8 | N/A | None Isothermal | 345 (2 hrs) | 10–15 | 100 | 43 | 71 | 170 | 3100 |
| A9 | N/A | None As-Cast Straight | N/A | N/A | 0 | 100 | 48 | ND | ND |
| A10/A11 | N/A | None As-Cast | N/A | N/A | 0 | 50–53 | 57–60 | ND | ND |

TABLE I-continued

| SPECIMEN | HEATER VOLTS | FEED RATE (cm/min) | $T_{peak}$ (°C.) | HEATING RATE (°C./min) | STRESS RELIEF FRACTION (%) | MAGNETIC PROPERTIES DC Hc (mOe) | DC $B_1/B_{100}$ (%) | AC @ 14 k guass mWatts/Lb | AC @ 14 k guass mVA/Lb |
|---|---|---|---|---|---|---|---|---|---|
| | | Wound | | | | | | | |

Figure 8:
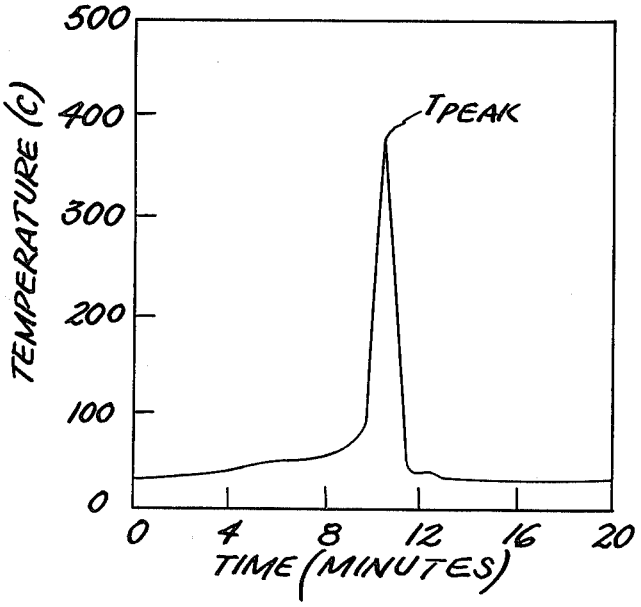
FIG. 8 is a graph of a typical temperature-time thermal cycle produced in amorphous metallic ribbon when dynamically annealed by the apparatus of FIG. 6 using a focussed heat source.

KEY:
N/A = Not Applicable
ND = Could Not Be Driven to 14 k gauss
X = Thermocouple Degraded A typical temperature-time profile of a ribbon instrumented with a spot welded thermocouple while passing through the impingement zones of beam 38 and cooling jet 40 is shown in FIG. 8. Heating rates as high as approximately 500° C./min were readily obtained. All heating rates reported herein were calculated by subtracting 80° C. from the peak temperature and dividing that quantity by the time required to heat the ribbon from 80° C. to the peak temperature. The heating rate was a function of both heater power (lamp volts) and ribbon feed rate. The peak temperature of the ribbon in the beam inpingement zone also changed with those parameters, i.e., the higher the lamp power, the higher the peak temperature, and the faster the feed rate (the less time spent in the beam impingement zone), the lower the peak temperature.

The temperature-time cycle of FIG. 8 shows that a cooling rate approximately as rapid as the heating rate can readily be obtained with the apparatus of FIG. 5. The objective of rapidly cooling the annealed amorphous metal is to ensure that no significant additional structural relaxation and/or no significant additional crystallization, if any, to the limit of no more than about 2% by volume, occurs during cooling. The minimum cooling rate required to ensure that substantially no structural relaxation and/or crystallization occurs during cooling can rigorously be calculated by integrating the equations used to derive FIG. 4 with respect to time. However, to a first engineering approximation, for most amorphous metals, the objective can be met by rapidly cooling at a rate of at least about 100° C./min.

As used herein and in the claims hereof the term rapidly cooling means cooling at a rate of at least about 100° C./minute.

Figure 9:
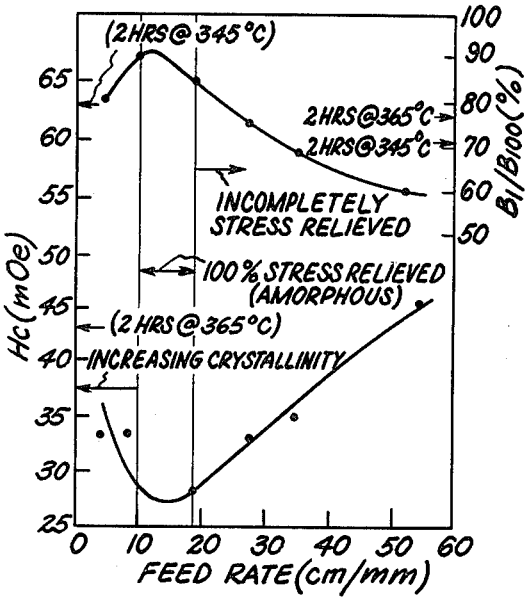
FIG. 9 is a graph of the direct current magnetic properties of $Fe_{81.5}B_{14.5}Si_4$ amorphous metallic ribbon dynamically annealed by the method of the invention on the apparatus of FIG. 6 and by conventional isothermal annealing.

The direct current (DC) magnetic properties of the ribbons of Example I, dynamically annealed by the method of my invention, are presented in graphical form in FIG. 9. Also presented in Table I and on FIG. 9, are DC magnetic property data for amorphous metallic ribbons of the same composition wound on the same diameter core forms and conventionally annealed isothermally for two hours, exclusive of heat-up and cool-down time, at annealing temperatures of 365° and 345° C. (Samples A7 and A8, respectively). Base-line data for similar amorphous metallic ribbon in the as-cast and uncoiled form and as-cast, but similarly coiled condition, is also presented in Table I (Samples A9 and A10-/A11, respectively).

From Table I and FIG. 9, the ribbons dynamically annealed by the method of my invention are seen to have soft magnetic properties that are considerably improved over those of ribbons stress relieved by prior art isothermal annealing. Further, the degrading effects of over-annealing, which produces crystallization, and the degrading effects of an incomplete stress relief on the soft magnetic properties may also be seen from FIG. 9.

EXAMPLE II

Figure 10:
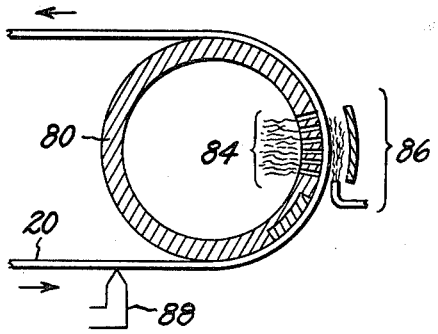
FIG. 10 shows schematically a portion of apparatus for annealing amorphous metallic ribbons using heated block contact heating means.

Two samples (2-1 and 2-2) of $Fe_{81.5}B_{14.5}Si_4$ amorphous metallic alloy ribbon 20 were stress relief annealed using the apparatus of FIG. 10 comprising 2" diameter hollow mandrel 80, resistance heated block 82 and ribbon bottom gas cooling jet orifices 84 and ribbon top gas cooling means 86. Those samples were instrumented with a chromel-alumel thermocouple 88 to obtain a measure of the heating rates typical of this type of apparatus. The thermocouples were as described in Example 1 except for the location which in this Example was the outside width surface of the ribbons, but was still the ribbon surface opposite from the heat source. The heating rate data produced are presented in Table II.

Since the samples instrumented with the thermocouples could not be used for magnetic measurements, a second series of samples (Samples D-1 to D-5 of Table II) were stress relief annealed using the apparatus of FIG. 10. The feed rates and block temperature used for this second series and the resulting magnetic property measurements are also presented in Table II.

Figure 11:
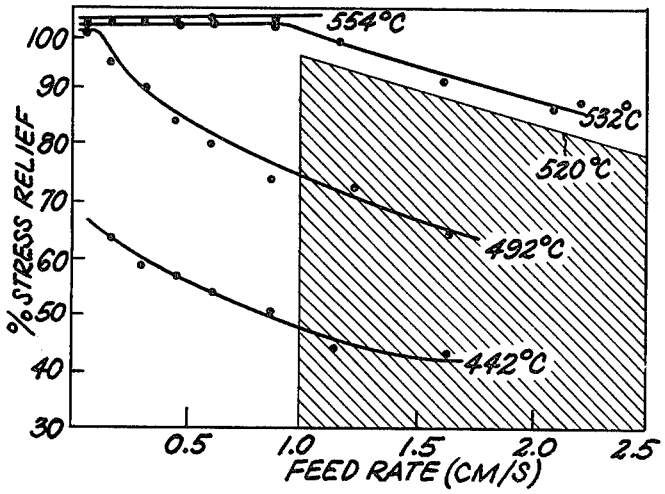
FIG. 11 is a graph of percent stress-relief versus feed rate for $Fe_{81.5}B_{14.5}Si_4$ amorphous metallic ribbons annealed at several temperatures using the apparatus of FIG. 10.

Using a different and more powerful heating block 82 in mandrel 80 so that higher block temperatures could be obtained, sufficient additional samples of $Fe_{81.5}B_{14.5}Si_4$ amorphous metallic alloy were stress relief annealed using the apparatus of FIG. 10 to provide the additional data graphed in FIG. 11. A crystallization temperature, $T_x$, of 470° C. was measured for this Fe-B-Si amorphous metallic alloy by Differential Scanning Calorimetry at a scanning rate of 20° C./min. Using that value of $T_x$ and the teachings of Senno et al., i.e., that for heated block devices $T_{block}$ should be in the range of $(T_x - 200° C.) \leqq T\ block \leqq (T_x + 50° C.)$ and the feed rate V should be the range $(1\ cm/sec) \leqq V \leqq (50\ cm/sec)$, the shaded portion of FIG. 11 was constructed.

Additional experiments similarly conducted, but not shown on FIG. 11, at 583° C. and 7.8 cm/sec feed rate resulted in 86% stress relief and at 600° C. at feed rates of 7.6, 9.6, 12.8, and 16.8 cm/sec, resulted in stress relief of 100%, 91%, 73%, and 44%, respectively.

TABLE II

| SPECIMEN | FEED RATE (cm/min) | $T_{block}$ (°C.) | $T_{peak}$ (°C.) | HEATING RATE (°C./min) | STRESS RELIEF FRACTION (%) | MAGNETIC PROPERTIES DC Hc (mOe) | DC $B_1/B_{100}$ (%) | AC @ 14 k guass mWatts/Lb | AC @ 14 k guass mVA/Lb |
|---|---|---|---|---|---|---|---|---|---|
| 2-1 | 4.1 | — | 439 | 129 | — | — | — | — | — |
| 2-2 | 4.1 | — | 515 | 206 | — | — | — | — | — |

TABLE II-continued

| SPECIMEN | FEED RATE (cm/min) | $T_{block}$ (°C.) | $T_{peak}$ (°C.) | HEATING RATE (°C./min) | STRESS RELIEF FRACTION (%) | MAGNETIC PROPERTIES DC Hc (mOe) | DC $B_1/B_{100}$ (%) | AC @ 14 k guass mWatts/Lb | AC @ 14 k guass mVA/Lb |
|---|---|---|---|---|---|---|---|---|---|
| D1 | 8 | 461 | | | 100 | 33 | 86 | 146 | 2988 |
| D2 | 18 | " | | | 100 | 30 | 87 | 143 | 1433 |
| D3 | 23 | " | | | 96 | 30 | 86 | 153 | 1967 |
| D4 | 34 | " | | | 96 | 35 | 81 | 171 | 1940 |
| D5 | 53 | " | | | 93 | 35 | 78 | 185 | 3198 |

FIG. 11 and the additional experiments thus show that if the feed rates and the stress relief annealing temperatures are selected in accordance with the teachings of Senno et al., the stress relief will be incomplete and, by logical extension, the magnetic properties will not be at their optimum. FIG. 11 and the additional data further show that there are no favorable combinations of the variables of annealing temperature and feed rate, within the ranges taught by Senno et al., that will produce amorphous metallic ribbons which have been stress relieved by at least about 95%.

Using the heating rate data of Samples 2-1 and 2-2 of Table II, an engineering approximation was made of the range of heating rates to be expected for the heating of thin ($\leqq 100$ μm) ribbons by contact heating with a hot block such as is done by the apparatus of FIG. 10. Assuming linear heat transfer to the ribbon, it was determined by elementary heat transfer analysis that the heating rate of the ribbon is independent of the rate at which the ribbon passes over the hot block. The analysis further showed that heating rate is a direct function of block temperature.

For a hot block whose temperature, $T_b$, is in the range of $(T_x-200°\ C.) \leqq T_b \leqq (T_x+50°\ C.)$ the analysis and an extrapolation of the data of Table II gave the result that the heating rate, dT/dt, of a ribbon pulled over the block ranges from about 50° to about 300° C./min for values of the crystallization temperature, $T_x$, which are typical for amorphous metals of compositions potentially useful for transformer applications.

Figure 12:
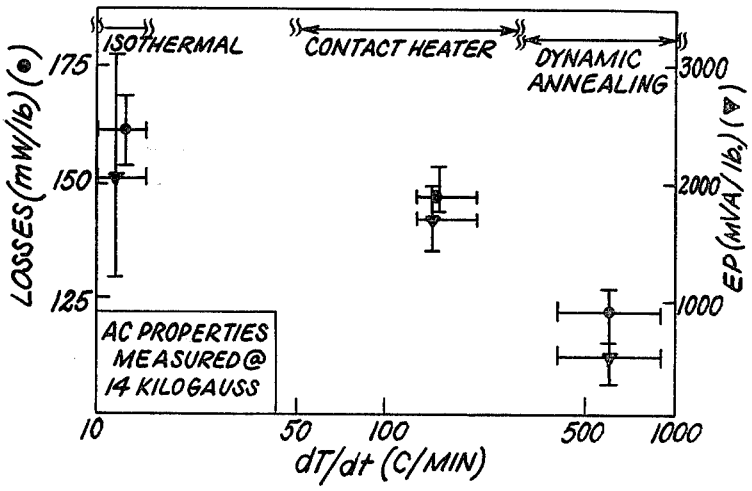
FIG. 12 is a semi-logarithmic graph comparing alternating current magnetic properties at 14 kilogauss of amorphous metallic ribbon annealed by conventional isothermal and contact block heater means and by the dynamic annealing method of the invention as a function of heating rate.

Using the above-obtained data and the above-discussed discoveries of my invention, the data of Tables I and II were combined to provide FIG. 12 which is a graph of the alternating current magnetic properties at 14 kilogauss of the $Fe_{81.5}B_{14.5}Si_4$ amorphous metallic alloys stress relieved by conventional isothermal annealing and contact heater annealing methods and by the dynamic annealing method of my invention as a function of the heating rates which are typical of those methods. FIG. 12 is semi-logarithmic with respect to the heating rate. Only those data which represent amorphous metallic ribbons which had been stress relieved by at least about 95% are graphed on FIG. 12; thus, only ribbons having the best magnetic properties as produced by each of the three methods, are graphed on FIG. 12. Across the top of FIG. 12 there are indicated typical ranges for the heating rates produced by the three methods, i.e., isothermal (10°-15° C./min), contact or block heater means (approximately 50°-300° C./min) and by the means used for the dynamic annealing method of my invention (greater than or equal to about 300° C./min).

FIG. 12 shows that even if a high degree of stress relief, i.e., greater than about 90%, is obtained, the magnetic properties will not be optimized unless the material is dynamically annealed in accordance with the teachings of my invention.

While my invention has been particularly shown and described above with reference to several preferred embodiments thereof, it is to be understood by those skilled in the art that various changes in form and detail may be made therein without departing from the true spirit and scope of my invention as defined by the claims herein set forth below.

What is claimed is:

1. A method for dynamically annealing amorphous metallic material comprising the steps of:
   (a) forming a single thickness of amorphous metallic material to a predetermined configuration;
   (b) heating the formed single thickness of amorphous metallic material to the highest peak temperature at the most rapid heating rate attainable subject to the proviso that substantially no crystallization is induced in said material in the time required during this heating step to reduce the stresses in said material by at least 90% of the stresses present in said material immediately prior to initiation of said heating step; and
   (c) immediately rapidly cooling the formed single thickness of amorphous metallic material while maintaining said predetermined configuration.

2. A method of claim 1 wherein said amorphous metallic material is in the form of a ribbon-like body.

3. The method of claim 1 wherein said stresses in said material are reduced by at least 95% of the stresses present in said material immediately prior to initiation of said heating step.

4. The method of claim 1 wherein said heating is conducted at a rate greater than about 300° C./min.

5. The method of claim 1 wherein said heating is performed by means of an impinging beam from a source selected from the group consisting of a laser beam source, electron beam source, and radiant heat source.

6. The method of claim 1 wherein said heating is performed by means of resistance self-heating.

7. The method of claim 1 wherein said cooling is conducted at a rate greater than about 100° C./min.

8. A method for dynamically annealing amorphous metallic material comprising the steps of:
   (a) forming a single thickness of amorphous metallic material to a predetermined configuration;
   (b) heating the formed single thickness of amorphous metallic material to the highest peak temperature attainable at a rate greater than about 300° C./min subject to the proviso that substantially no crystallization is induced in said material in the time required during this heating step to reduce the stresses in said material by at least 90% of the stresses present in said material immediately prior to initiation of said heating step; and (c) immediately rapidly cooling the formed signal thickness of amorphous metallic material while maintaining said predetermined configuration.

9. The method of claim 8 wherein said amorphous metallic material is in the form of a ribbon-like body.

10. The method of claim 8 wherein said stresses in said material are reduced by at least 95% of the stresses present in said material immediately prior to initiation of said heating step.

11. The method of claim 8 wherein said heating is performed by means of an impinging beam from a source selected from the group consisting of a laser beam source, electron beam source, and radiant heat source.

12. The method of claim 8 wherein said heating is performed by means of resistance self-heating.

13. The method of claim 8 wherein said cooling is conducted at a rate greater than about 100° C./min.

* * * * *